US007530846B1

(12) United States Patent
Chen

(10) Patent No.: US 7,530,846 B1
(45) Date of Patent: May 12, 2009

(54) CONNECTOR INSULATOR FOR FEMALE CONNECTOR

(75) Inventor: Ying-Chung Chen, Taipei Hsien (TW)

(73) Assignee: Chief Land Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 11/963,769

(22) Filed: Dec. 21, 2007

(51) Int. Cl.
*H01R 13/648* (2006.01)

(52) U.S. Cl. ..... 439/608

(58) Field of Classification Search ..... 439/608
See application file for complete search history.

(56) References Cited

U.S. PATENT DOCUMENTS 6,471,549 B1 * 10/2002 Lappohn ..... 439/608

6,764,341 B2 * 7/2004 Lappoehn ..... 439/608

* cited by examiner

*Primary Examiner*—Truc T Nguyen

(57) ABSTRACT

A connector insulator for a female connector includes a plurality of U-shaped grounding terminal openings and signal terminal openings surrounded by the grounding terminal openings. A plurality of terminal modules corresponding to the grounding terminal openings and the signal terminal openings are fitted into a side of the connector insulator. Signal terminals and U-shaped grounding terminals of a male connector are fitted into the signal terminal openings and the grounding terminal openings to be electrically connected with signal pins and grounding pins of the terminal modules, respectively. Because the U-shaped grounding terminals surround the signal terminals so the connector insulator having the U-shaped grounding terminal openings provides an improved EMI shielding.

4 Claims, 10 Drawing Sheets

CONNECTOR INSULATOR FOR FEMALE CONNECTOR

BACKGROUND OF THE INVENTION

1. Field of the Invention

The present invention relates to a connector insulator for a female connector, and in particular to a connector insulator that includes U-shaped grounding terminal openings.

2. The Prior Arts

Electromagnetic compatibility (EMC) comprises two different kinds of issues, electromagnetic interference (EMI) and electromagnetic susceptibility (EMS). EMI is related to the electromagnetic noise produced by an electrical device that interferes with other system. EMS is related to correct operation of electrical equipment in the presence of unplanned electromagnetic disturbances.

A conventional electrical connector uses metal grounding member and grounding terminals to prevent the EMI. Moreover, configurations of the electrical connector also affect the EMI shielding effect.

Referring to FIGS. 1A and 1B, a conventional electrical connector includes a male conductor 14 and a female conductor. The female connector includes a connector insulator 10 and a plurality of terminal modules 12 inserted into the connector insulator 10. The connector insulator 10 has a plurality of L-shaped grounding terminal openings 10*a* and signal terminal openings 10*b* adjacent to the L-shaped grounding terminal openings 10*a*. The male connector 14 includes a plurality of L-shaped grounding terminals 14*a* corresponding to the grounding terminal openings 10*a* and a plurality of post-shaped signal terminals 14*b* corresponding to the signal terminal openings 10*b*. When the male connector 14 is engaged with the female connector, the grounding terminals 14*a* and the signal terminals 14*b* are inserted into the grounding terminal openings 10*a* and the signal terminal openings 10*b*, respectively. Therefore, the grounding terminals 14*a* and the signal terminals 14*b* are electrically connected with grounding pins (not shown in figures) and signal pins (not shown in figures) of the terminal modules 12, respectively. Bridge portions are disposed between the grounding terminals 14*a* to connect the grounding terminals 14*a* in series. The grounding terminals 14*a* may be formed as individual pieces and then connected with each other in series, or be integrally formed as a single piece.

However, after testing, it shows part of electromagnetic interference was not transmitted from the L-shaped grounding terminals 14*a* to the grounding ends 12*a* via the terminal modules 12. The connector insulator 10 has zones 16 affected by electromagnetic interference as shown in FIG. 1B.

SUMMARY OF THE INVENTION

A primary objective of the present invention is to provide a connector insulator for a female connector having U-shaped grounding terminal openings. A U-shaped grounding terminal of a male connector corresponding to the U-shaped grounding terminal opening surrounds signal terminals better than a conventional L-shaped grounding terminal does. Thus, the connector insulator having the U-shaped grounding terminal openings provides better EMI shielding.

A connector insulator according to the present invention includes a plurality of U-shaped grounding terminal openings and signal terminal openings surrounded by the grounding terminal openings. A plurality of the terminal modules corresponding to the grounding terminal openings and the signal terminal openings are inserted into a side of the connector insulator. The connector insulator is approximately rectangular. Each signal terminal of the male connector is inserted into the signal terminal opening to be electrically connected with a signal pin of the terminal module. The U-shaped grounding terminal of the male connector surrounds the signal terminals, is inserted into the U-shaped grounding terminal opening and is electrically connected with a grounding pin of the terminal module. Because the U-shaped grounding terminal according to the present invention surrounds the signal terminals more than the conventional L-shaped grounding terminal does, the U-shaped grounding terminal provides improved EMI shielding.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
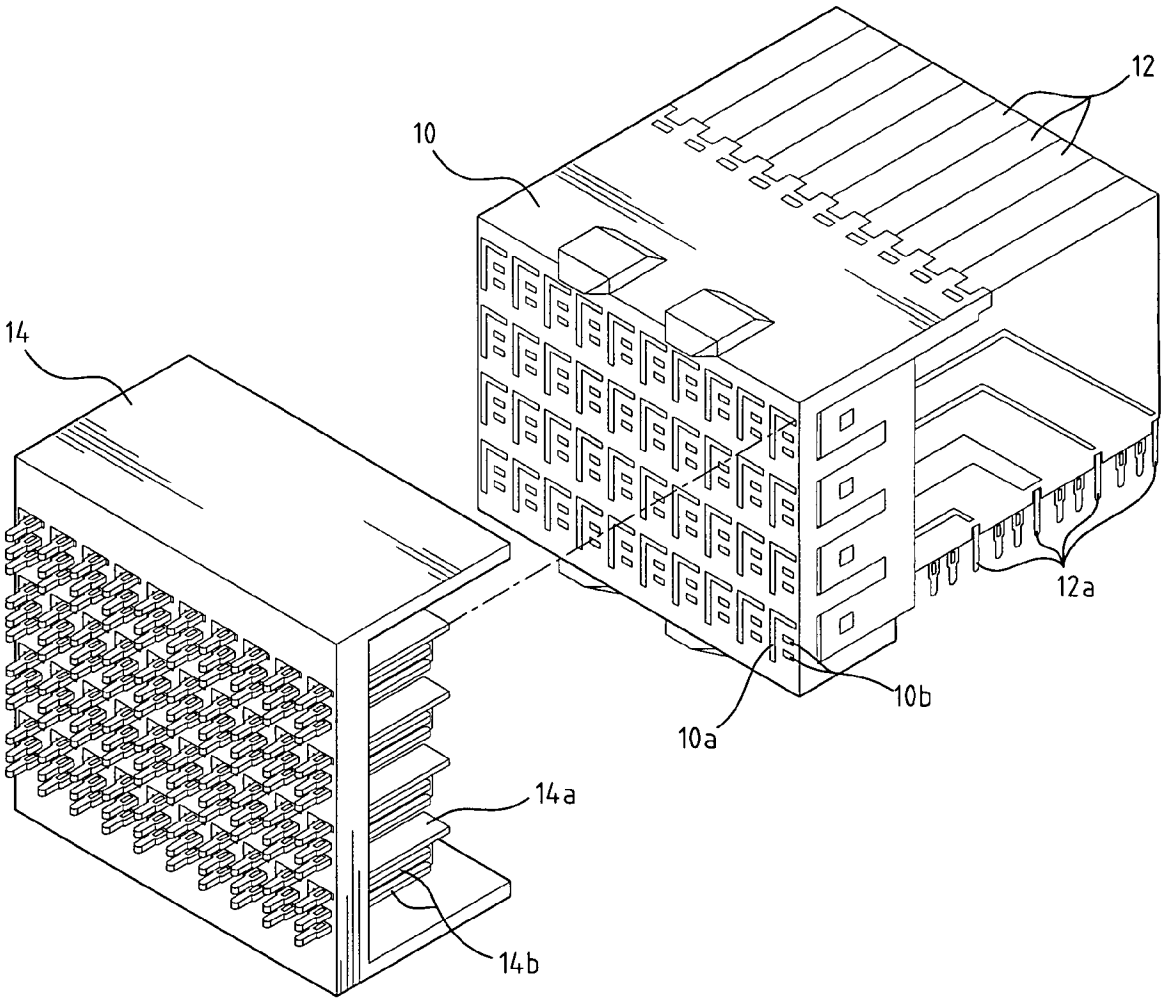
FIG. 1A ( Prior Art )
FIG. 1A is an explosive view showing a conventional electrical connector having L-shaped grounding terminals.
Figure 1B:
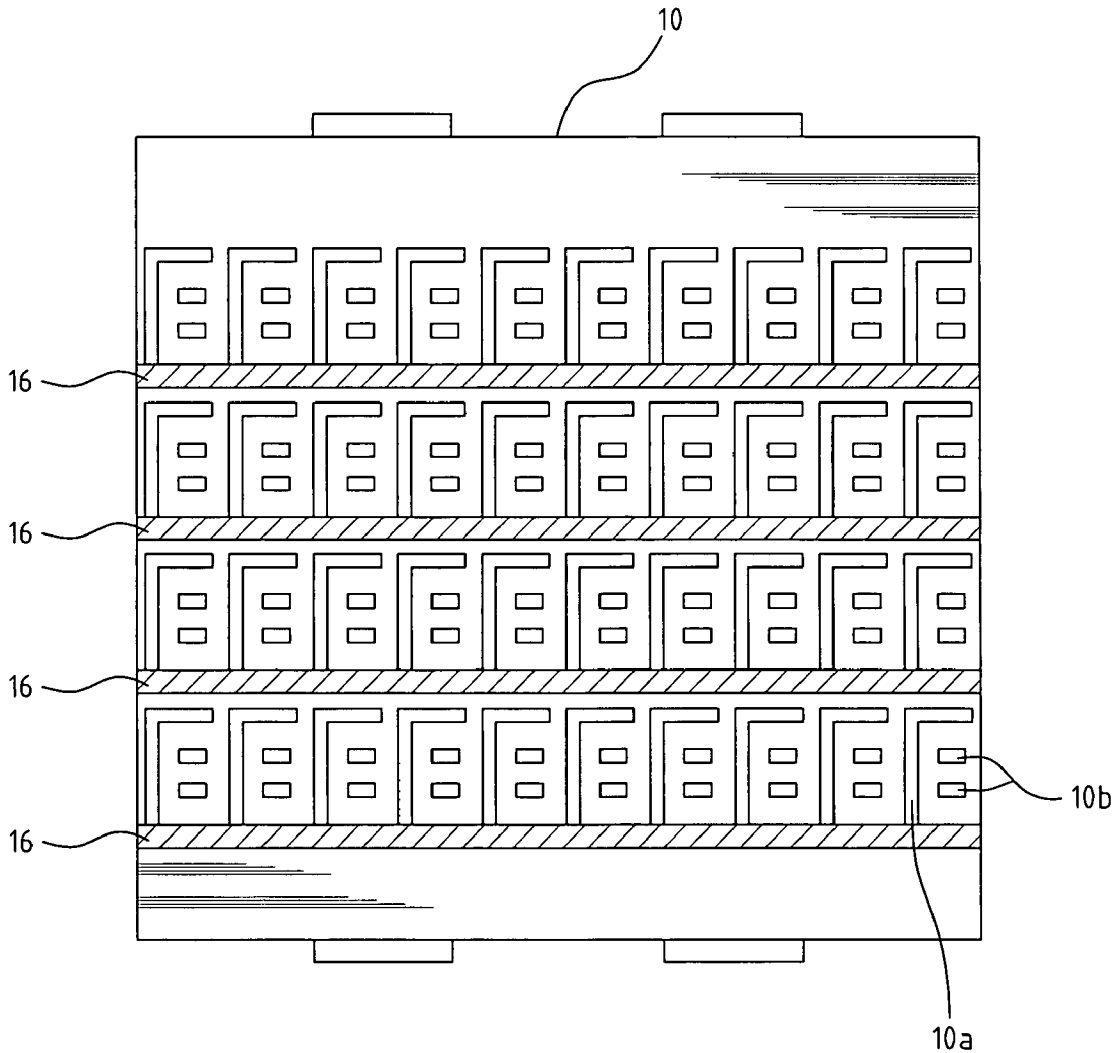
FIG. 1B ( Prior Art )
FIG. 1B is a front view showing areas on a connector insulator of the conventional electrical connector affected by electromagnetic interference.
Figure 2A:
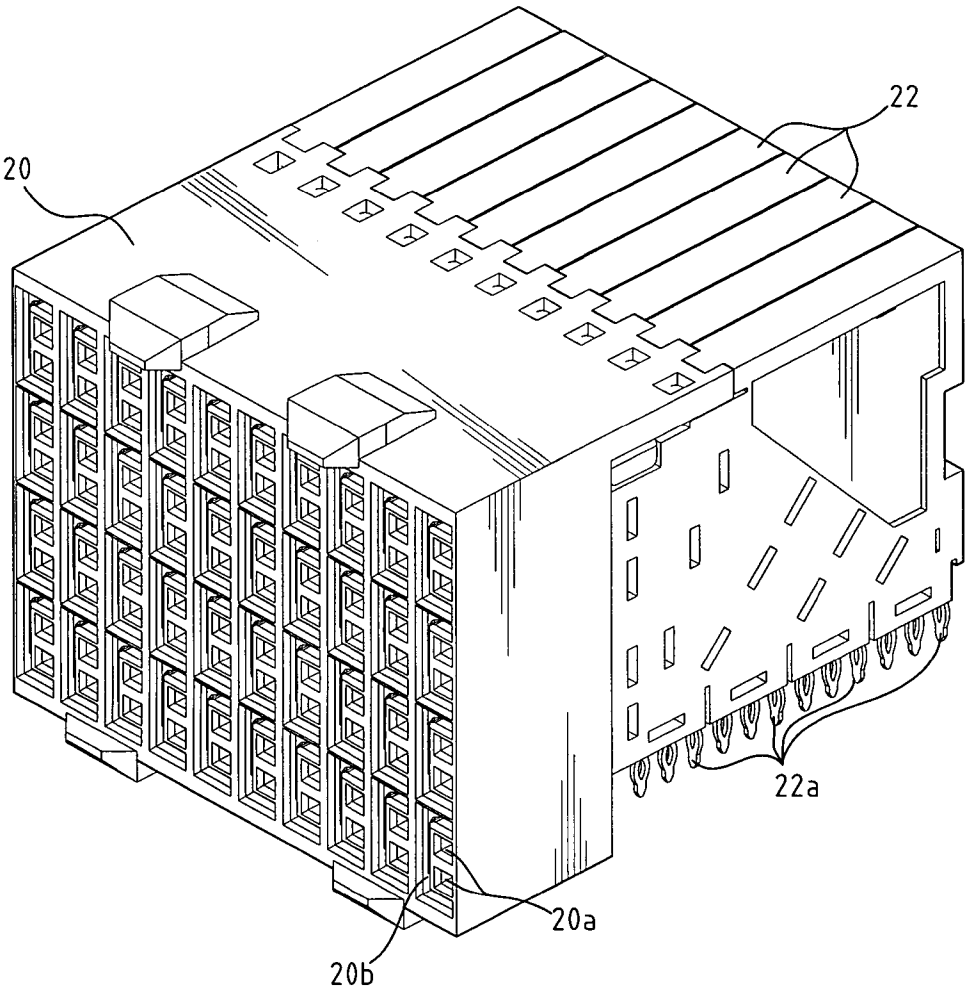
FIG. 2A is a perspective view showing a female connector having a connector insulator according to the present invention and a plurality of terminal modules.
Figure 2B:
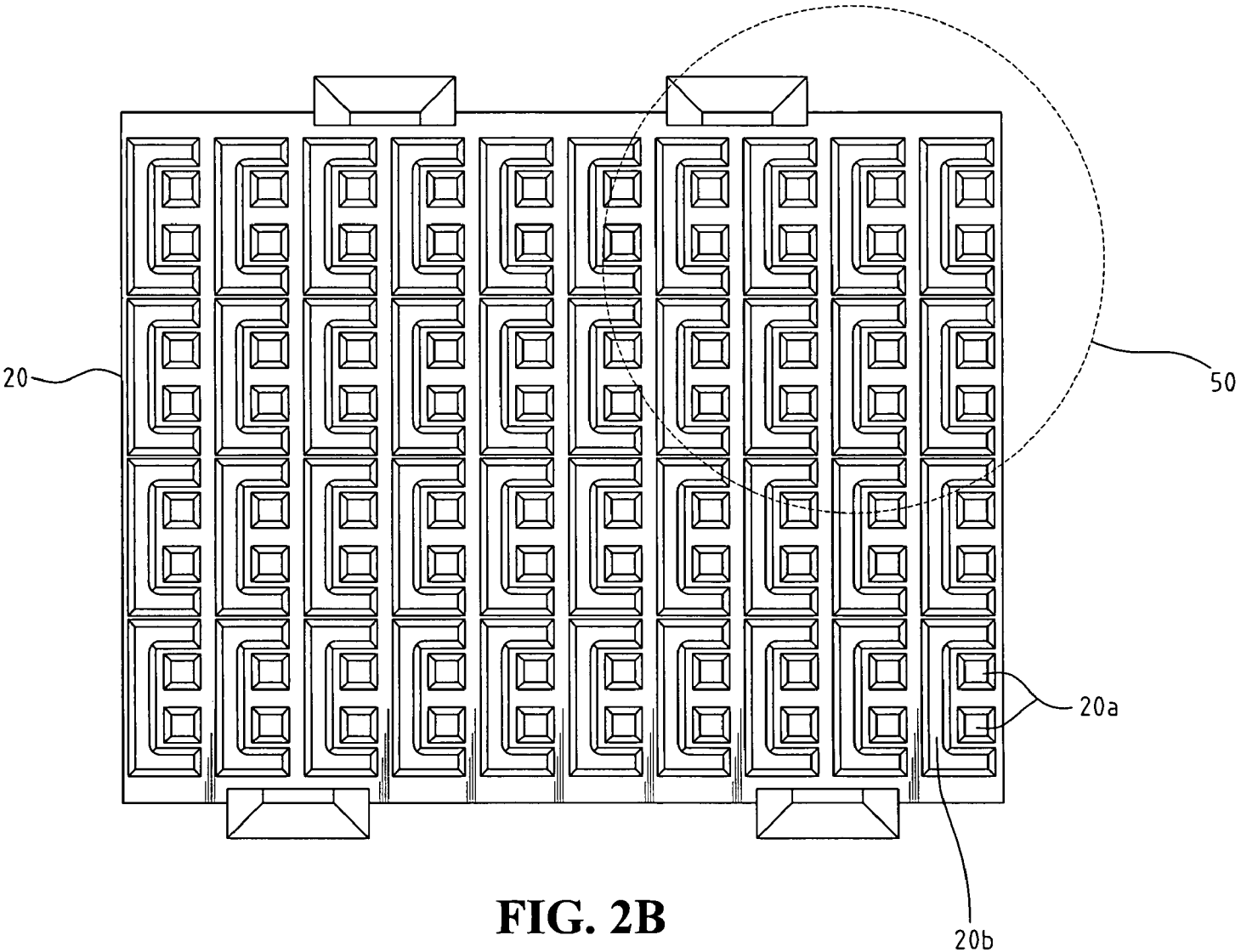
FIG. 2B is a front view showing the connector insulator having U-shaped grounding terminal openings and signal terminal openings.
Figure 2C:
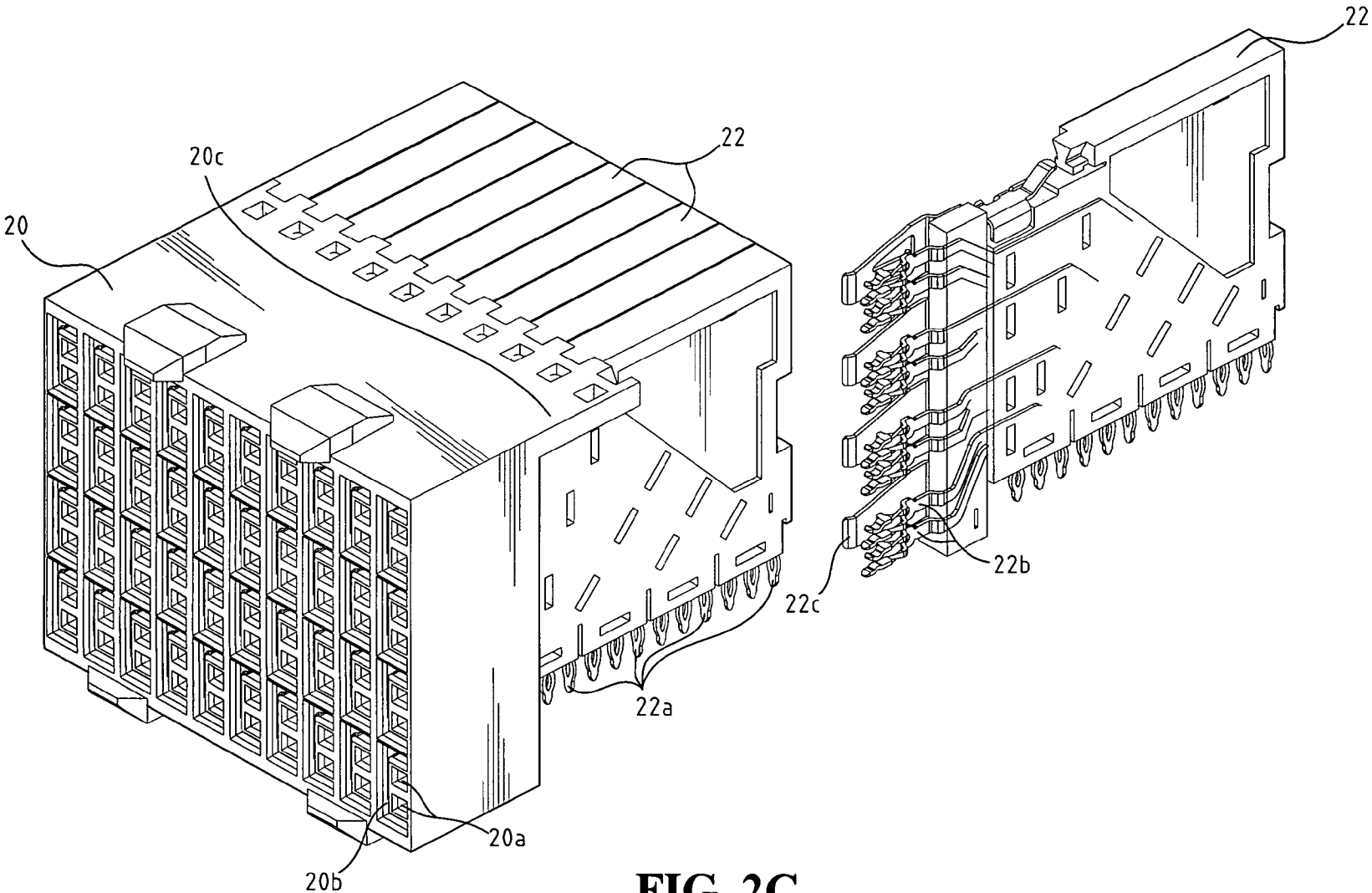
FIG. 2C is a perspective view showing the female connector, and one of the terminal modules is pulled out.
Figure 3:
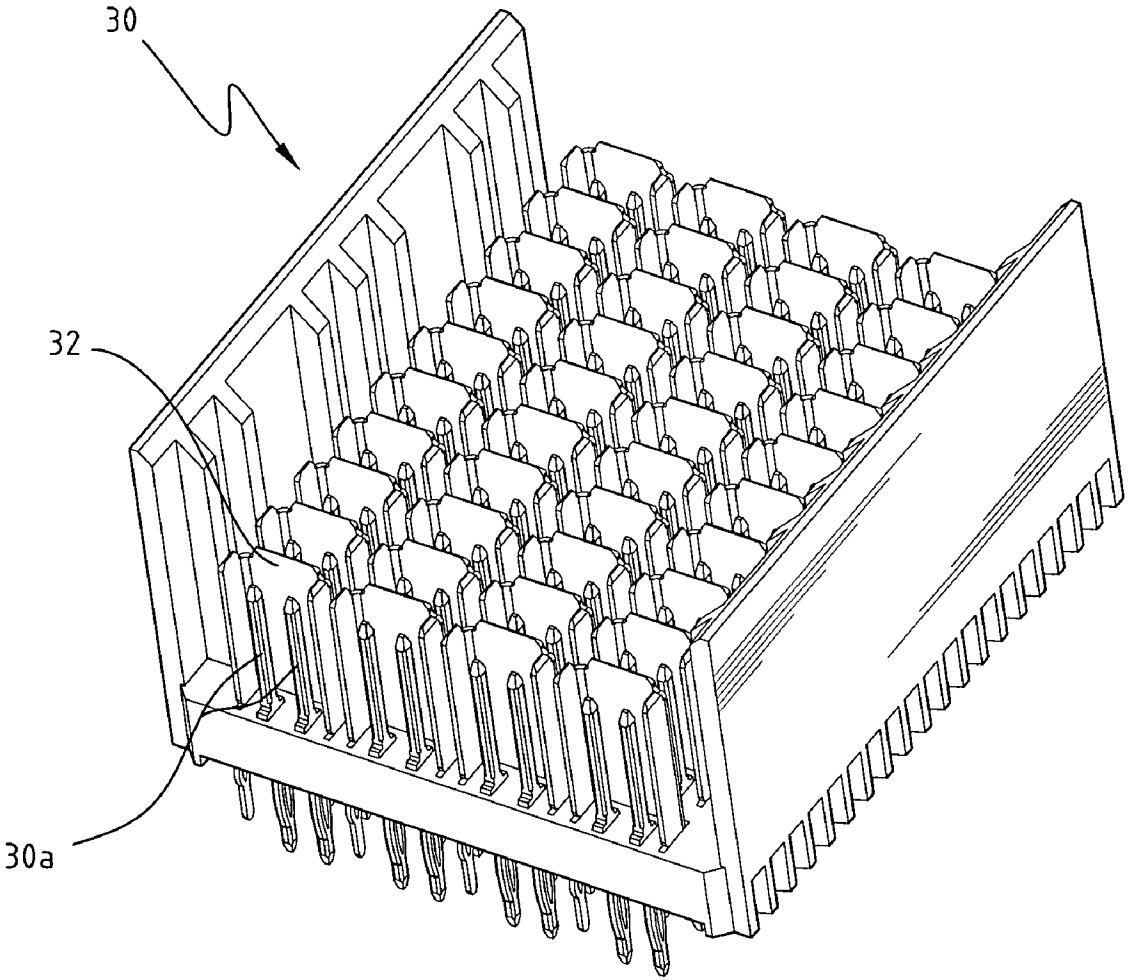
FIG. 3 is a perspective view showing a male connector having U-shaped grounding terminals and signal terminals.

An electrical connector includes a male connector 30 (as shown in FIG. 3) and a female connector (as shown in FIGS. 2A-2C), which has a connector insulator 20 according to the present invention and a plurality of terminal modules 22.

Referring to FIGS. 2A-2C, the connector insulator 20 according to the present invention has an approximately rectangular main body and includes a plurality of U-shaped grounding terminal openings 20*b* and signal terminal openings 20*a* surrounded by the grounding terminal openings 20*b*. The terminal modules 22 corresponding to the signal terminal opening 20*a* and grounding terminal openings 20*b* are fitted into the connector insulator 20.

Referring to FIG. 2B, the signal terminal openings 20*a* are rectangular. The signal terminal openings 20*a* are surrounded by the U-shaped grounding terminal openings 20*b*. Referring to FIG. 2C, the terminal module 22 includes a plurality of metal grounding ends 22*a*, fork-shaped signal pins 22*b* and grounding pins 22*c*. The signal pins 22*b* and the grounding pins 22*c* are corresponding to the signal terminal openings 20*a* and the grounding terminal openings 20*b*, respectively.

Referring to FIG. 3, the male connector 30 includes a plurality of post-shaped signal terminals 30*a* and U-shaped grounding terminals 32. The signal terminals 30*a* are surrounded by the grounding terminals 32. The signal terminals 30*a* and grounding terminals 32 are corresponding to the signal terminal openings 20*a* and the grounding terminals 20*b*, respectively.

When the male connector 30 is engaged with the female connector, each of the signal terminals 30*a* and the grounding terminals 32 are inserted into the female connector. When the post-shaped signal terminals 30*a* are inserted into the signal terminal openings 20*a* of the connector insulator 20, the signal terminals 30*a* are electrically connected with the terminal modules 22. More specifically speaking, the signal terminals 30*a* are electrically connected with the fork-shaped signal pins 22*b*. In the similar way, when the grounding terminals 32 are inserted into the female connector, the grounding terminal 32 are electrically connected with grounding pins 22*c* of the terminal modules 22. Then, the electromagnetic interference is directed to the metal grounding ends 22*a* and removed.

The U-shaped grounding terminal 32 corresponding to the grounding terminal opening 20*b* surrounds the signal terminals 30*a* more than a conventional grounding terminal does. Thus the connector insulator 20 according to the present invention, which has the U-shaped grounding terminal opening 20*b*, provides improved EMI shielding.

Figure 4:
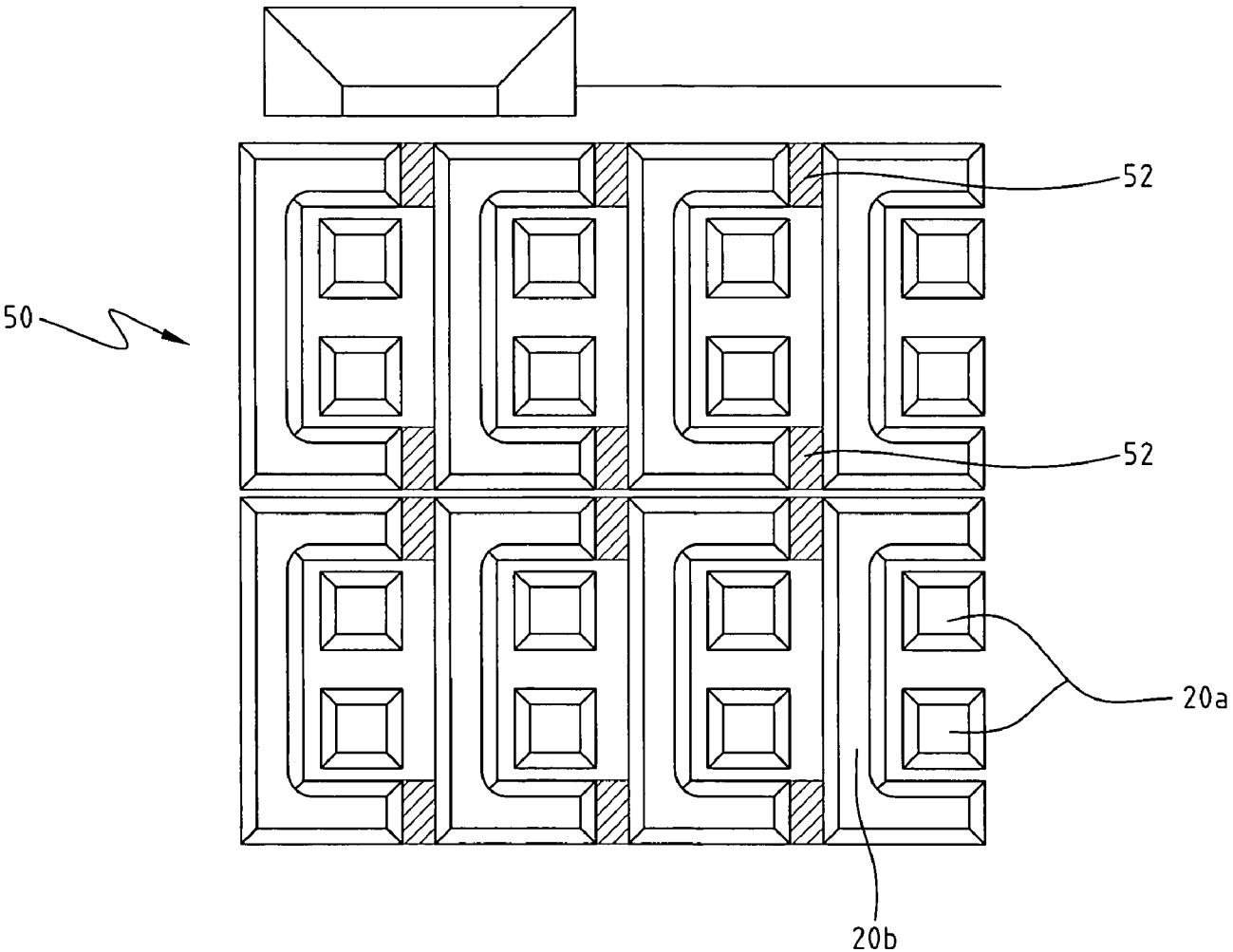
FIG. 4 is a detail view showing areas on the connector insulator affected by electromagnetic interference.

FIG. 4 is a detailed view showing a zone 50 of FIG. 2B. FIG. 4 is a schematic view showing areas 52 on the connector insulator 20 according to the present invention affected by electromagnetic interference. When the connector insulator 20 according to the present invention is used, the U-shaped grounding terminals 32 corresponding to the grounding terminal openings 20*b* surround the signal terminals 30*a* more than the conventional grounding terminals. Thus, the areas 52 affected by electromagnetic interference are limited to small areas between the grounding terminal openings 20*b* as shown in FIG. 4.

Figure 5A:
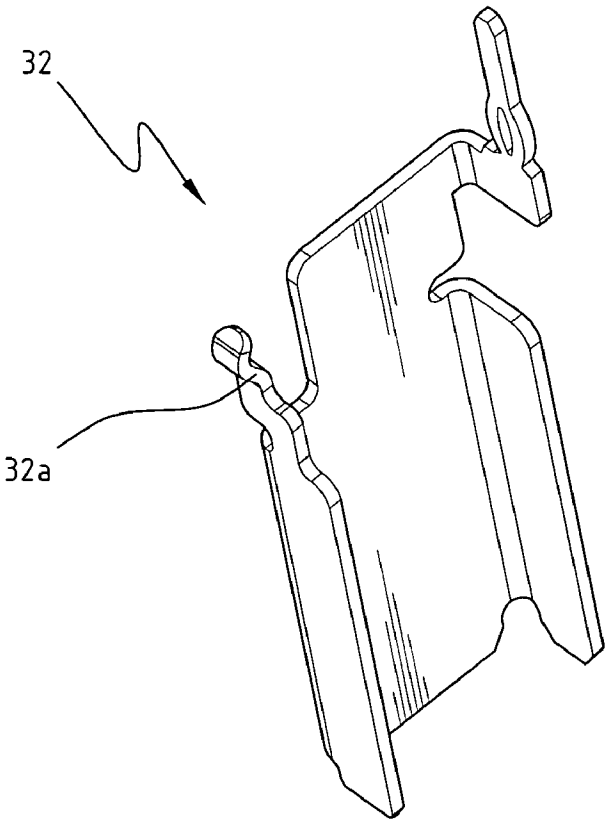
FIG. 5A is a perspective view showing the U-shaped grounding terminal of the male connector.
Figure 5B:
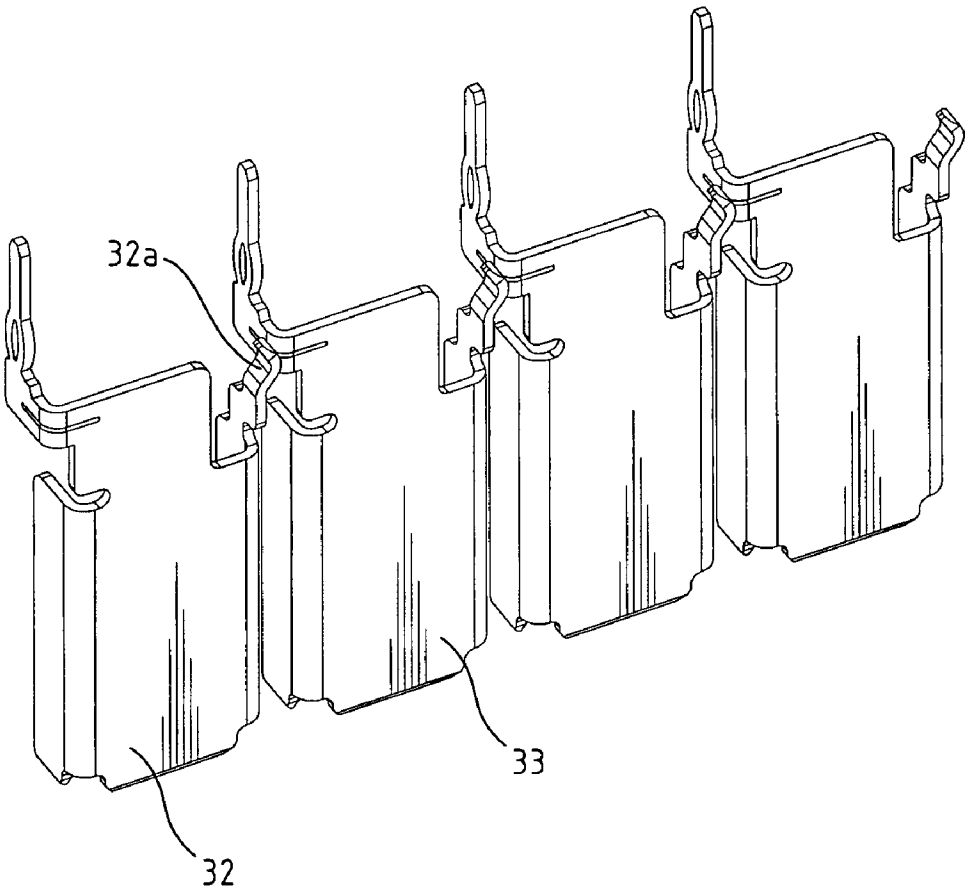
FIG. 5B is a perspective view showing the grounding terminals connected in series.
Figure 5C:
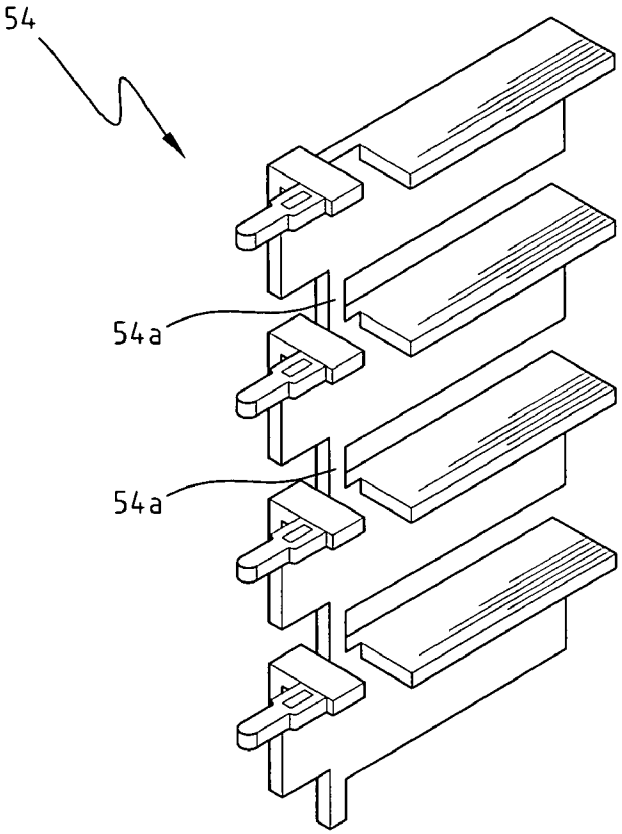
FIG. 5C is a perspective view showing the L-shaped grounding terminals connected in series.

The grounding terminals 32 may be formed as individual pieces and then be connected in series, or be integrally formed as a single piece. Referring to FIG. 5A, the grounding terminal 32 has an elastic contact portion 32*a*. FIG. 5B shows that the grounding terminals 32 and 33 according to the present invention are connected by the elastic contact portion 32*a*. When the plurality of grounding terminals 32 is fitted into the grounding terminal openings 20*b*, the grounding terminals 32 are electrically connected in series. The grounding terminal opening 20*b* can be engaged with the U-shaped grounding terminal 32 or the conventional L-shaped grounding terminal. Referring to FIG. 5C, an integrally-formed grounding row 54 includes the plurality of conventional L-shaped grounding terminals. A plurality of bridge portions 54*a* connects the grounding terminals in series. The grounding row 54 can be fitted into the U-shaped grounding terminal openings 20*b* of the connector insulator 20 and has a performance similar to that of the U-shaped grounding terminals 32.

Referring to FIG. 2*c*, the connector insulator 20 further includes a rail portion 20*c*. The rail portion 20*c* has a plurality of guiding rails at a bottom thereof (not shown in Figures). The terminal modules 22 can glide along the guiding rails to be inserted into the connector insulator 20.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A connector insulator for a female connector having a plurality of U-shaped grounding terminal openings, a plurality of terminal modules being fitted into the connector insulator, the connector insulator comprising:

a rectangular main body;

a plurality of signal terminal openings defined on the main body, each signal terminal opening allowing a signal terminal to be fitted into the signal terminal opening and to be electrically connected with a signal pin of one of the terminal modules; and a plurality of U-shaped grounding terminal openings defined on the main body and surrounding the signal terminal openings, each U-shaped grounding terminal opening allowing a grounding terminal to be fitted into the U-shaped grounding terminal opening and to be electrically connected with a grounding pin of one of the terminal modules;

wherein each grounding terminal has an elastic contact portion and a plurality of grounding terminals are formed in a male connector and electrically connected with each other in series by the elastic contact portions.

2. The connector insulator as claimed in claim 1, wherein the connector insulator comprises a rail portion extended from the main body, the rail portion has a plurality of guiding rails at a bottom thereof, and the terminal modules glide along the guiding rails to be inserted into the connector insulator.

3. The connector insulator as claimed in claim 1, wherein each grounding terminal is U-shaped.

4. The connector insulator as claimed in claim 1, wherein each grounding terminal is L-shaped.

* * * * *